US006079612A

United States Patent [19]

Tung

[11] Patent Number: 6,079,612

[45] Date of Patent: Jun. 27, 2000

[54] BIG SCALE (500CC) GOLF CLUB HEAD FABRICATION METHOD

[76] Inventor: Kun-Ming Tung, No.30,Feng-Lin second Rd., Ta-LIao Shiang,Kaoshung Hsien, Taiwan

[21] Appl. No.: 09/119,627

[22] Filed: Jul. 21, 1998

[51] Int. Cl.[7] ..... B23K 1/20; B23K 15/06; A63B 53/02; A63B 53/04

[52] U.S. Cl. ..... 228/219; 228/118; 228/205; 228/221; 228/171; 228/173.6; 473/309; 473/345; 473/346; 273/167; 273/80.2

[58] Field of Search ..... 228/205, 219, 228/221, 171, 118; 473/331, 345, 346, 309; 273/33, 167

[56] References Cited

U.S. PATENT DOCUMENTS

| | | | |
|---|---|---|---|
| 5,085,432 | 2/1992 | Takeno | 273/33 |
| 5,205,560 | 4/1993 | Hoshi et al. | 273/167 |
| 5,228,615 | 7/1993 | Iijima et al. | 228/118 |
| 5,232,224 | 8/1993 | Zeider | 273/167 |
| 5,460,376 | 10/1995 | Schmidt et al. | 273/167 A |
| 5,464,216 | 11/1995 | Hoshi et al. | 273/167 R |
| 5,485,998 | 1/1996 | Kobayashi | 273/80.2 |
| 5,501,468 | 3/1996 | Endo | 273/167 H |
| 5,505,795 | 4/1996 | Tsai et al. | 148/527 |
| 5,533,729 | 7/1996 | Leu | 473/346 |
| 5,556,097 | 9/1996 | Endo et al. | 473/309 |
| 5,669,059 | 9/1997 | Carden | 419/12 |
| 5,676,605 | 10/1997 | Kobayashi | 473/331 |
| 5,706,566 | 1/1998 | Igarashi | 29/527.5 |
| 5,755,627 | 5/1998 | Yamazaki et al. | 473/345 |
| 5,769,307 | 6/1998 | Takeda | 228/114.5 |
| 5,799,859 | 9/1998 | Cheng | 228/157 |
| 5,873,791 | 2/1999 | Allen | 473/309 |

*Primary Examiner*—Patrick Ryan
*Assistant Examiner*—Cecilia Newsome
*Attorney, Agent, or Firm*—Varndell & Varndell, PLLC

[57] ABSTRACT

A big scale (500 cc) golf club head fabrication method includes the step of preparing molds for making a top cover panel, a bottom cover panel and a face panel, the step of preparing metal alloy plate materials and then cutting the metal alloy plate materials into the desired sizes and then using the molds thus obtained to forge the metal alloy plate materials into the desired top cover panel, bottom panel and face panel respectively, and the step of welding the obtained top cover panel, bottom panel and face panel in a vacuum tank to form a golf club head and then polishing the golf club head into a finished product.

3 Claims, 3 Drawing Sheets

BIG SCALE (500CC) GOLF CLUB HEAD FABRICATION METHOD

BACKGROUND OF THE INVENTION

The present invention relates to a golf club head fabrication method, and more particularly to a method of fabricating a big scale (500 cc±10%) golf club head.

Regular golf club heads generally weigh within 180 g~208 g. If the weight of the head of a golf club is out of this range, the user will have difficulty moving the golf club freely. Further, in order to increase the striking face of the face panel of a golf club head, the size of the golf club head must be relatively increased. However, increasing the area of the face panel may simultaneously increases the weight of the golf club head.

SUMMARY OF THE INVENTION

The present invention provides a golf club head fabrication method which is practical for fabricating a big scale (500 cc±10%) golf club head. It is another object of the present invention to provide a golf club head fabrication method which is practical for fabricating a big scale (500 cc±10%) golf club head that weights within the 180 g~208 g.

DETAILED DESCRIPTION OF THE PREFERRED EMBODIMENT

Figure 1:
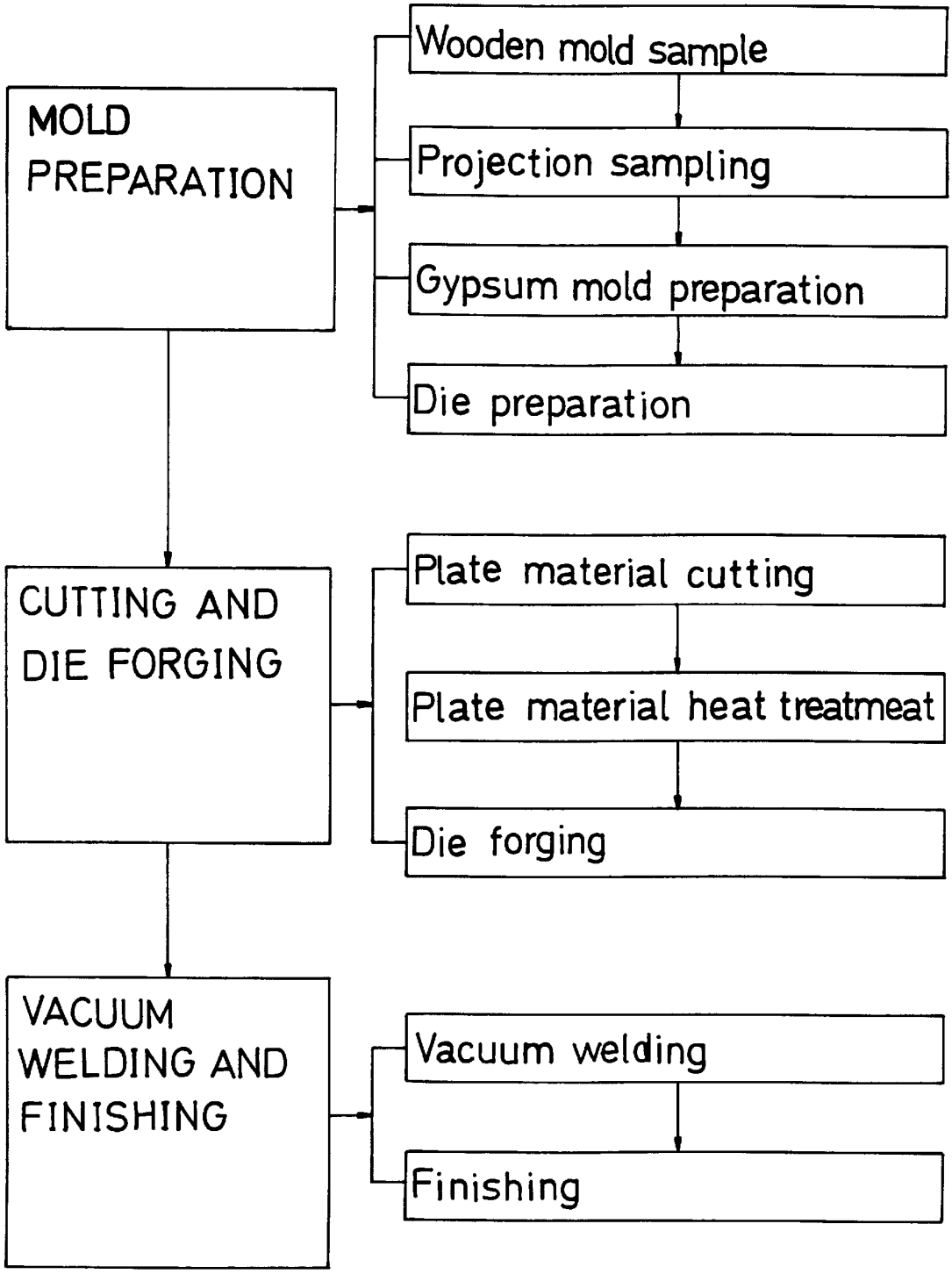
FIG. 1 is a block diagram of the present invention.
Figure 3:
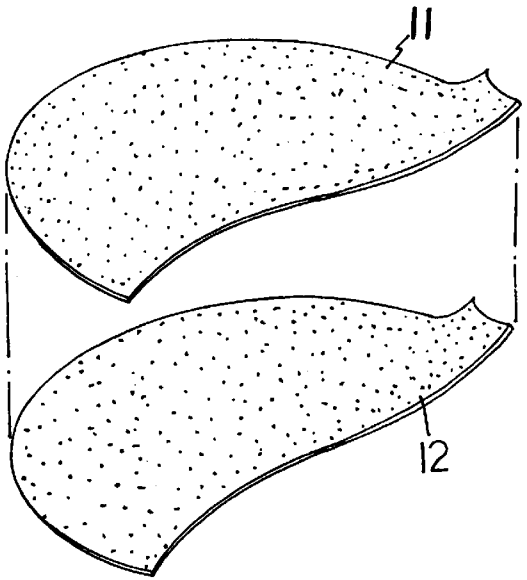
FIG. 3 is an exploded view of a top gypsum mold and a bottom gypsum mold according to the present invention.

Referring to FIG. 1, a big scale golf club head fabrication method comprises the steps of:

1. Making wooden mold: making a wooden mold sample subject to the volume of the designed (500 cc±10%) club head.
2. Setting peripheral lines: obtaining the peripheral lines of the top cover panel, the bottom panel and the face panel properly from the wooden mold sample by means of projection.
3. Making gypsum molds: making respective upper gypsum molds and respective bottom gypsum molds for the top cover panel, the bottom panel and the face panel subject to the wooden mold sample and the peripheral lines obtained.
4. Making dies for die forging: making respective upper dies and bottom dies for the top cover panel, the bottom panel and the face panel.
5. Material preparation: Preparing plate materials subject to the designed thickness (β titanium alloy of thickness within about 2.5 mm~1.8 mm for the face panel, β titanium alloy or type 64 titanium alloy of thickness within about 0.8 mm~1.2 mm for the top cover panel and the bottom panel), then cutting the prepared plate materials to the desired sizes.
6. Heating the prepared plate materials: reinforcing the structural strength of the prepared materials by heating the prepared plate material for the top cover panel to about within 550° C.~800° C., the prepared plate material for the bottom panel to about within 650° C.~800° C., the prepared plate material for the face panel to about 850° C.
7. Die forging: using the prepared dies to forge the heated plate materials into the desired top cover panel, bottom panel and face panel.
8. Gas-protection welding: putting the forged top cover panel, bottom panel and face panel in a vacuum tank and then welding the panels to form a golf club head.
9. Finishing: polishing the golf club head thus obtained into a finished product.

Figure 2:
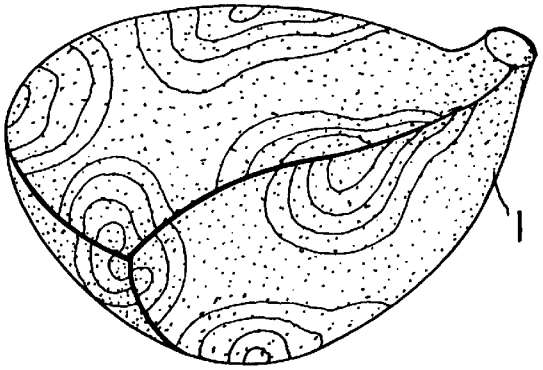
FIG. 2 shows a wooden mold sample made according to the present invention.
Figure 4:
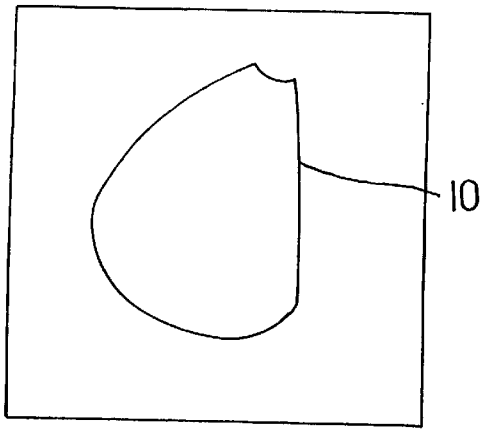
FIG. 4 shows a peripheral line of a panel obtained by projection according to the present invention.
Figure 6:
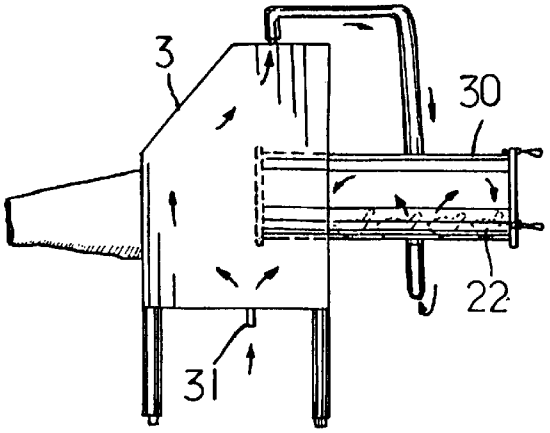
FIG. 6 shows the panels put in a vacuum tank and welded according to the present invention.
Figure 5:
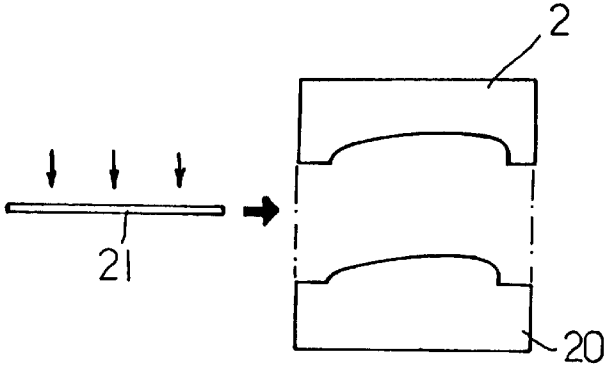
FIG. 5 shows the forging of a plate material in a forging die according to the present invention.
Figure 7:
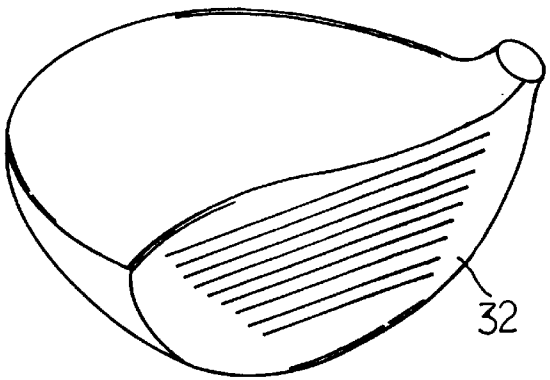
FIG. 7 shows a finished golf club head according to the present invention.

The fabrication method of the present invention includes three stage; namely, the first stage of mold preparation, which includes the aforesaid steps 1 through 4, the second stage of cutting and die forging, which includes the aforesaid steps 5 through 7, and the third stage of vacuum welding and finishing, which includes the aforesaid steps 8 and 9. At the first stage of mold preparation, a wooden mold sample 1 is prepared (see FIG. 2), then top gypsum mold 11 and bottom gypsum mold 12 for each panel (the top cover panel, the bottom panel and the face panel) are respectively prepared, and then upper die 2 and bottom die 20 for each panel (see FIG. 5) are respectively made by means of the prepared gypsum molds 11,12 and the peripheral line 10 (see FIG. 4) for each panel. At second stage of cutting and die forging, plate materials 21 are obtained subject to the designed thickness (β titanium alloy of thickness within about 2.5mm~1.8 mm for the face panel, β titanium alloy or type 64 titanium alloy of thickness within about 0.8 mm~1.2 mm for the top cover panel and the bottom panel), and cut to the desired sizes, and then forged into the desired shape by means of the dies 2,20 (see FIG. 5). At the third stage of vacuum welding and finishing, the shape formed top cover panel, bottom panel and face panel thus obtained from the aforesaid second stage of cutting and die forging, the shape formed panels 22 are respectively put in a cleaning chamber 30 of a vacuum container, then argon gas is filled in the vacuum container 3 to clean the shape formed panels 22 and to keep the vacuum container 3 in a vacuum condition (see FIG. 6), and then the shape formed panels are welded into a golf club head, and polished into a finished golf club head 32 (see FIG. 7).

What I claim is:

1. A big scale (500 cc) golf club head fabrication method comprising the steps of:

I) making a wooden mold sample subject to the volume of the designed club head;

ii) obtaining the peripheral lines of the top cover panel, the bottom panel and the face panel properly from the wooden mold sample thus obtained by means of projection;

iii) making respective upper gypsum molds and respective bottom gypsum molds for the top cover panel, the bottom panel and the face panel subject to the wooden mold sample and the peripheral lines thus obtained;

iv) making respective upper dies and bottom dies for the top cover panel, the bottom panel and the face panel;

v) preparing plate materials subject to the designed thickness, then cutting the prepared plate materials to the desired sizes;

vi) reinforcing the structural strength of the prepared materials by a heat treatment;

vii) using the prepared dies to forge the heat-treated plate materials into the desired top cover panel, bottom panel and face panel;

viii) putting the forged top cover panel, bottom panel and face panel in a vacuum tank and then welding the panels to form a club head; and ix) polishing the golf club head thus obtained into a finished product.

2. The big scale (500 cc) golf club head fabrication method of claim 1 wherein the plate materials for the top cover panel and the bottom panel are preferably made of type 64 titanium alloy, and the plate material for the face panel is preferably made of β titanium alloy.

3. The big scale (500 cc) golf club head fabrication method of claim 1 wherein the plate materials for the top cover panel and the bottom panel are preferably of thickness within about 0.8 mm~1.2 mm, and the plate material for the face panel is preferably of thickness within about 2.5 mm~1.8 mm.

* * * * *